US006682372B2

(12) United States Patent
Grimmeisen

(10) Patent No.: US 6,682,372 B2
(45) Date of Patent: Jan. 27, 2004

(54) MOTORIZED WATERCRAFT

(76) Inventor: Andrea Grimmeisen, Wiener Str. 193, DE-70469 Stüttgart (DE)

( * ) Notice: Subject to any disclaimer, the term of this patent is extended or adjusted under 35 U.S.C. 154(b) by 0 days.

(21) Appl. No.: 10/009,626

(22) PCT Filed: Feb. 19, 2001

(86) PCT No.: PCT/EP01/01835

§ 371 (c)(1),
(2), (4) Date: Apr. 1, 2002

(87) PCT Pub. No.: WO01/62347

PCT Pub. Date: Aug. 30, 2001

(65) Prior Publication Data

US 2002/0119712 A1 Aug. 29, 2002

(30) Foreign Application Priority Data

Feb. 26, 2000 (DE) ..... 100 09 197
Feb. 28, 2000 (DE) ..... 100 09 278

(51) Int. Cl.[7] ..... B63H 21/17
(52) U.S. Cl. ..... 440/6; 114/315
(58) Field of Search ..... 114/312, 315, 114/316, 321, 330–333, 337, 338; 440/6, 7, 38; 441/65, 74; 60/221, 222

(56) References Cited

U.S. PATENT DOCUMENTS 2,722,021 A 11/1955 Keogh-Dwyer
3,408,976 A * 11/1968 Ellis ..... 440/38
3,543,712 A 12/1970 Vasilatos
5,017,166 A * 5/1991 Chang ..... 440/7
5,462,460 A * 10/1995 Kobaysahi ..... 440/6
5,878,687 A 3/1999 Grimmeisen
6,036,555 A * 3/2000 Takacs ..... 440/6
6,311,631 B1 * 11/2001 Beecher ..... 114/55.56
6,325,683 B1 * 12/2001 Yocom ..... 440/6
6,409,560 B1 * 6/2002 Austin ..... 441/74
6,461,204 B1 * 10/2002 Takura et al. ..... 440/6

FOREIGN PATENT DOCUMENTS

DE 2 100 827 7/1972
EP 816 222 1/1998
JP 05058388 A * 3/1993 ..... B63C/11/46
WO WO 9200124 A1 * 1/1992 ..... A63B/35/12
WO 96/30087 10/1996

* cited by examiner

*Primary Examiner*—S. Joseph Morano
*Assistant Examiner*—Ajay Vasudeva
(74) *Attorney, Agent, or Firm*—Pauley Petersen & Erickson

(57) ABSTRACT

A motorized watercraft having a hull on which the user can lie or stand wherein a flow channel is provided with an engine-driven water screw. The electric engine, batteries and control device for the electric engine are accommodated in the hull of the watercraft. The water screw, electric engine and control device are embodied as a drive unit and positioned in the flow channel. The batteries for the electric engine are arranged in a separate, interchangeable housing which is built into the hull of the watercraft. As a result, the motorized watercraft has a substantially simplified structure, is user friendly and easy to maintain.

10 Claims, 1 Drawing Sheet

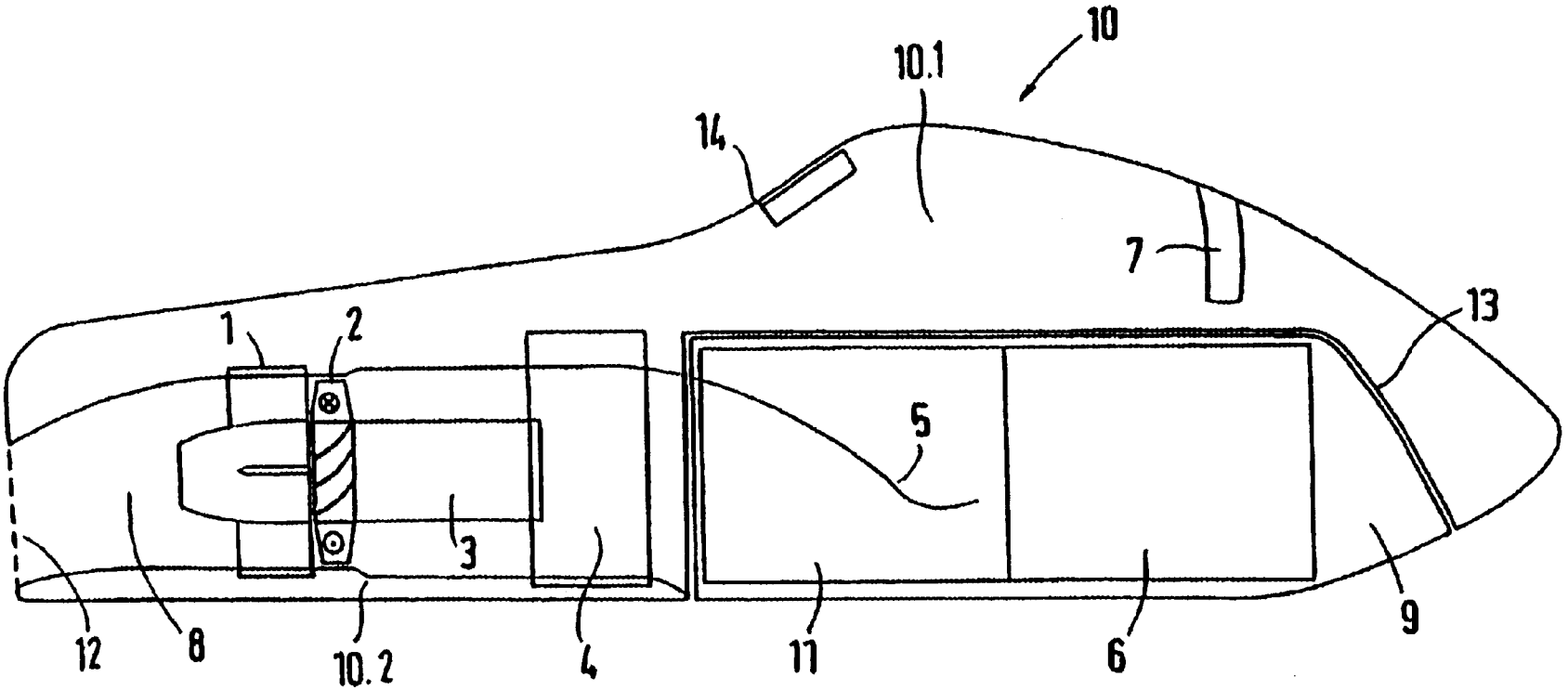
10
10.1
14
7
13
9
6
5
11
4
3
2
1
10.2
8
12

MOTORIZED WATERCRAFT

BACKGROUND OF THE INVENTION

1. Field of the Invention

This invention relates to a motorized watercraft with a hull of the craft, on which the user lies prone or stands, with a flow channel extending in the hull of the craft with a motor-driven water screw, wherein an electric motor and batteries, as well as a control device for the electric motor are housed in the hull of the craft.

2. Description of Related Art

A motorized watercraft of this type is known from PCT International Publication WO 96/30087. There, the user lies prone on the hull of the craft, and the water screw in the flow channel is driven by a battery-powered electric motor so that a water flow is aspirated through the flow channel which extends opposite the movement direction of the motorized watercraft. Thus the water flow can be kept away from the user, and the flow of the channel water can also be conducted past the user by means of the shape of the hull of the watercraft. This simplifies swimming and diving with the motorized watercraft.

The design of the structure of the motorized watercraft is complicated and is not user-friendly with respect to maintenance.

SUMMARY OF THE INVENTION

It is one object of this invention to simplify a motorized watercraft of the type mentioned above and to design it user-friendly.

In accordance with this invention, this object is attained with the water screw, the electric motor and the control device designed as an underwater drive unit and placed in the flow channel. The batteries for the electric motor are placed into a separate housing, installed in the hull of the craft so that it can be exchanged.

The combination of the water screw, the electric motor and the control device for the electric motor into one underwater unit, and their placement in the flow channel results in a considerable simplification of the structure of the elements, in particular the hull of the craft, and of the maintenance of the motorized watercraft. The batteries placed in a separate housing can be easily removed for charging and can be replaced by a new housing containing charged batteries.

This rapid replacement makes the motorized watercraft particularly ready for use and is therefore user-friendly, since it can be employed very rapidly.

Because the electric motor is seated directly in the flow channel, it is cooled by the water flow. Thus it is possible to omit additional cooling devices and the parts outlay or cost for the motorized watercraft is considerably further reduced. If required, the control device can also be cooled in the same way.

If the hull of the craft has a surface for prone use or a platform for the user above the flow channel, it can be used in two ways.

The construction can be further simplified by forming the flow channel as one piece with the hull of the craft.

In one embodiment which is particularly advantageous, the flow channel starts with an inflow opening in the area of the bow of the hull of the craft and terminates in an outflow opening in the area of the stern of the hull of the craft. The underwater drive unit is installed in the flow channel as a suction device.

In accordance with one embodiment, the housing of the batteries is such that the housing with the batteries is inserted into a recess formed in the underside of the hull of the craft which is arranged outside of the flow channel and the inflow opening in the area of the bow of the hull of the craft.

In one embodiment, there are two different types of employment of the motorized watercraft while in the prone or standing position. A remote control device is assigned to the underwater drive unit, which is releasably attached to the hull of the craft and can be brought into operative contact with the control device of the underwater unit over a wireless transmission path.

For a simple maintenance or repair of the underwater drive unit, the hull of the craft has a plate, flap or the like, which can be opened, in the flow channel below the underwater drive unit, through which there is access to the underwater unit.

BRIEF DESCRIPTION OF THE DRAWING

This invention is explained in greater detail in view of a motorized watercraft represented in a lateral view in the drawing.

DESCRIPTION OF PREFERRED EMBODIMENTS

The exterior shape of the hull 10 of the craft essentially corresponds to the exterior shape of the hull of the motorized watercraft known from PCT International Publication WO 96/30087. The flow channel 8 extends from the inflow opening 11 in the area of the bow to the flow exit 12 in the area of the stern of the hull 10 of the craft. An underwater drive unit includes a stator 1, an electric motor 3, a water screw 2 and the motor control device 4 is installed in the flow channel 8, which is slightly downward curved in the areas of the inflow opening 11 and the outflow opening 12. The stator 1 is in stationary connection with the hull 10 of the craft. In addition to its actual electric motor function, it also straightens the rotating water flow generated in the flow channel 8. An increase in efficiency is thus achieved. Such underwater drive units can today be designed so that they can be used in flowing water without problems. Therefore the hull 10 can be freely provided outside of the flow channel 8 and can be designed simply, with advantageous flow and user-friendly.

The flow channel 8 can be formed in one piece with the hull 10 of the craft. In the present embodiment the flow channel 8 is formed by an upper shell 10.1 and a lower shell 10.2 which are connected with each other by suitable fastening means. The flow channel 8 is made accessible for maintenance of the underwater drive unit by removing the lower shell 10.2. But a plate, a flap, or the like can be provided below the underwater drive unit, by which access to the underwater drive unit exists.

A recess 13 is formed in the underside in the area of the bow of the upper shell 10.1 of the shell 10 of the hull, into which a housing 9 with batteries 5 and 6 is releasably inserted. The housing 9 with the chargeable batteries 5 and 6 can be easily and rapidly exchanged and can be replaced by a housing 9 with charged batteries 5 and 6, so that the motorized watercraft is always ready for use.

The area of the inflow opening II of the flow channel 8 is covered at the top by means of the housing 9 so that easy access to the rotor 2 is prevented, but water can be conveyed at a sufficient flow volume. With this simple step the rotor 2 is only accessible when the housing 9 is removed, such as when the electric motor 3 is currentless.

If the user lies prone on the hull 10 of the craft, the user can hold onto the grip elements 7 or gripping depressions. Operating elements of a manual control device are integrated into one or both grip elements 7. A wireless remote control device is provided for the case where the motorized water craft is not operated in a prone position, but so that the user stands on the hull 10 of the craft, and is connected with the motor control device 4 via a radio connection. The manual control device 14, which preferably communicates in a wireless manner with the motor control device 4, is maintained in the field of view of the user on the hull 10 of the craft. If the user stands on the hull 10 of the craft, the manual control device 14 can be released from the hull 10 of the craft and used. On it, various operational states, for example the actual speed, the diving depth or the charge state of the batteries 5, 6 can be displayed.

What is claimed is:

1. In a motorized watercraft having a hull of the craft on which a user lies prone or stands, with a flow channel extending in the hull of the craft with a motor-driven water screw, wherein an electric motor and batteries as well as a control device for the electric motor are housed in the hull of the craft, the improvement comprising:

the water screw (2), the electric motor (1, 3) and the control device (4) forming an underwater drive unit and placed in the flow channel (8);

the batteries (5, 6) for the electric motor (1, 3) placed into a separate housing (9) which is exchangeably installed in the hull (10) of the craft into a recess (13) formed in an underside of the hull (10) of the craft, which is arranged outside of the flow channel (8) and the inflow opening (11) near the bow of the hull (10) of the craft; and at least one of a manual control device for a prone user and a remote control device for a standing user assigned to the underwater drive unit and in operative contact with the control device (4) of the underwater drive unit.

2. In the motorized watercraft in accordance with claim 1, wherein the hull (10) of the craft has one of a surface for prone use and a platform for the user above the flow channel (8).

3. In the motorized watercraft in accordance with claim 2, wherein the flow channel (8) is formed in one piece with the hull (10) of the craft.

4. In the motorized watercraft in accordance with claim 3, wherein the flow channel (8) starts with an inflow opening (11) near a bow of the hull (10) of the craft and terminates in an outflow opening (12) near a stern of the hull (10) of the craft, and the underwater drive unit is installed in the flow channel (8) as a suction device.

5. In the motorized watercraft in accordance with claim 1, wherein a remote control device is assigned to the underwater drive unit, which is releasably attached to the hull (10) of the craft and is brought into operative contact with the control device (4) of the underwater unit over a wireless transmission path.

6. In the motorized watercraft in accordance with claim 1, wherein the flow channel (8) starts with an inflow opening (11) near a bow of the hull (10) of the craft and terminates in an outflow opening (12) near a stern of the hull (10) of the craft, and the underwater drive unit is installed in the flow channel (8) as a suction device.

7. In the motorized watercraft in accordance with claim 1 wherein the hull (10) of the craft has one of a plate and a flap which can be opened, in the flow channel below the underwater drive unit, providing access to the underwater unit.

8. In a motorized watercraft having a hull of the craft on which a user lies prone or stands, with a flow channel extending in the hull of the craft with a motor-driven water screw, wherein an electric motor and batteries as well as a control device for the electric motor are housed in the hull of the craft, the improvement comprising:

the water screw (2), the electric motor (1, 3) and the control device (4) forming an underwater drive unit and placed in the flow channel (8);

the batteries (5, 6) for the electric motor (1, 3) placed into a separate housing (9) which is exchangeably installed in the hull (10) of the craft, into a recess (13) formed in an underside of the hull (10) of the craft, which is arranged outside of the flow channel (8) and the inflow opening (11) near the bow of the hull (10) of the craft; and one of a plate and a flap which can be opened, in the flow channel below the underwater drive unit, providing access to the underwater unit.

9. In the motorized watercraft in accordance with claim 8, wherein the flow channel (8) is formed in one piece with the hull (10) of the craft.

10. In a motorized watercraft having a hull of the craft on which a user lies prone or stands, with a flow channel extending in the hull of the craft with a motor-driven water screw, wherein an electric motor and batteries as well as a control device for the electric motor are housed in the hull of the craft, the improvement comprising: the water screw (2), the electric motor (1, 3) and the control device (4) forming an underwater drive unit and placed in the flow channel (8);

the batteries (5, 6) for the electric motor (1, 3) placed into a separate housing (9) which is exchangeably installed in the hull (10) of the craft; and a remote control device assigned to the underwater drive unit, the remote control device releasably attached to the hull (10) of the craft and brought into operative contact with the control device (4) of the underwater drive unit over a wireless transmission path.

* * * * *